US010837742B2

(12) United States Patent
Romero

(10) Patent No.: US 10,837,742 B2
(45) Date of Patent: Nov. 17, 2020

(54) BROADHEAD WITH ADJUSTABLE BLADE ANGLE AND CUTTING DIAMETER

(71) Applicant: Scott Romero, Newport, NC (US)

(72) Inventor: Scott Romero, Newport, NC (US)

(73) Assignee: RRAD, LLC, Newport, NC (US)

( * ) Notice: Subject to any disclaimer, the term of this patent is extended or adjusted under 35 U.S.C. 154(b) by 0 days.

(21) Appl. No.: 16/436,793

(22) Filed: Jun. 10, 2019

(65) Prior Publication Data

US 2019/0376772 A1 Dec. 12, 2019

Related U.S. Application Data

(60) Provisional application No. 62/682,310, filed on Jun. 8, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 4,452,460 | A * | 6/1984 | Adams | F42B 6/08 473/584 |
| 5,564,713 | A * | 10/1996 | Mizek | F42B 6/08 473/583 |
| 5,879,252 | A * | 3/1999 | Johnson | F42B 6/08 473/583 |
| 6,165,086 | A * | 12/2000 | Liechty, II | F42B 6/08 473/583 |
| 6,554,727 | B1 * | 4/2003 | Armstrong | F42B 6/08 473/583 |
| 9,303,963 | B1 * | 4/2016 | Ford | F42B 6/08 |
| 2016/0195376 | A1 * | 7/2016 | Rowley | F42B 6/08 473/583 |

* cited by examiner

*Primary Examiner* — John A Ricci
(74) *Attorney, Agent, or Firm* — Eric B. Fugett; Mark A. Pitchford; Pitchford Fugett, PLLC

(57) ABSTRACT

A broadhead for an arrow has improved opening characteristics and an adjustable cut span such that an archer may adjust cutting span of the main cutting blades of the broadhead to balance penetration with cut width. That is, cut width may be reduced to increase penetration depending on the type of target the archer or hunter is faced with. The arrow includes a collar threaded on the main body of the broadhead to limit the rearward travel of the main cutting blades as they pivot open from the main body of the broadhead upon impact with a target, such that moving the collar by rotating it about the main body adjusts the angle and cut width of the main cutting blades in their deployed position. The broadhead further includes forward cutting surfaces on the main blades configured to open the blades upon impact with the target.

20 Claims, 5 Drawing Sheets

BROADHEAD WITH ADJUSTABLE BLADE ANGLE AND CUTTING DIAMETER

CROSS-REFERENCES TO RELATED APPLICATIONS

This application claims priority to U.S. Provisional Patent Application Ser. No. 62/682,310 entitled "BROADHEAD WITH ADJUSTABLE BLADE ANGLE AND CUTTING DIAMETER" filed on Jun. 8, 2018.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure related generally to the field of archery and more specifically to a broadhead with folding blades configured to open upon impact with a target.

Broadheads are designed to create cuts in a target (e.g., game or enemy) larger than the arrow shaft of the arrow carrying the broadhead. Fixed blade broadheads are guaranteed to provide these extended cuts in the target, however, the blades being extended radially from the arrow shaft during flight decreases the accuracy of the arrow. Mechanical blade broadheads are designed to launch from a bow with main cutting blades tucked tight to a main body of the arrow shaft and open upon impact with the target. Therefore, mechanical blade broadheads provide improved ballistic characteristics over fixed blade broadheads (similar to target tipped arrows) while delivering cut spans equal to or larger than fixed blade broadheads. Mechanical blade broadheads known in the prior art occasionally suffer from failure to open reliably or failure to fully penetrate a target to provide mortal wounding of the target. That is, prior art mechanical blade broadheads may hang on a target's skin or bone instead of penetrating to the vital organs of the target.

Prior art mechanical broadheads have two known opening mechanisms. In one implementation, prior art mechanical broadheads have ledges ahead of an attachment point of the main cutting blades to a main body of the broadhead. The main cutting blades extend through the main body of the broadhead, and the ledges are integral with the main cutting blades. These ledges impact the target just after a tip of the broadhead, pushing the main cutting blades back and out from the main body of the broadhead. The ledges are large and blunt and can drastically reduce arrow velocity upon impact if opening does not occur properly. Additionally, the ledges remain exposed while the broadhead is traveling through the target, further reducing the penetration of the arrow.

In another implementation, prior art mechanical broadheads have main cutting blades pivotally attached to the main body of the broadhead, and the blades are folded forward toward a tip of the broadhead when launched. A band is used to hold the blades closed until the broadhead impacts the target. Blunt levers or hooks trail the pivot point, and upon impact, the hooks engage the hide or bone of the target, generating enough force to cut (i.e., break) the band or displace the band rearward (in addition to the rearward force on the band from traveling into and through the target) such that the hooks or levers pry the blades open. These hook type broadheads provide excellent penetration, but may fail to open. If they fail to open, the lethality of the broadhead is compromised due to the relatively small cut spans inflicted on the target by the broadhead. Failure to penetrate and failure to open cause injury to a target which may be non-lethal (even though a serious injury to an animal) or may allow an animal to travel far enough for a hunter to lose the animal. It is much preferred to reliably deliver a large cut span through a target such that the target is cleanly harvested with a minimal amount of delay and suffering.

BRIEF SUMMARY OF THE INVENTION

Aspects of the present invention provide a broadhead for an arrow with improved opening characteristics and an adjustable cut span such that an archer may adjust cutting span of the main cutting blades of the broadhead to balance penetration with cut width. That is, cut width may be reduced to increase penetration depending on the type of target the hunter is faced with. The arrow includes a collar threaded on the main body of the broadhead to limit the rearward travel of the main cutting blades as they pivot open from the main body of the broadhead upon impact with a target, such that moving the collar by rotating it about the main body adjusts the angle and cut width of the main cutting blades in their deployed position. The broadhead further includes forward cutting surfaces on the main blades configured to open the blades upon impact with the target.

In one aspect, a broadhead includes a main body, an adjustable stop, and at least one blade. The main body extends along a longitudinal axis. The adjustable stop is affixed to the main body and has a plurality of stop positions. The adjustable stop is configured to contact the blade in the deployed position of the blade and set an angle of the main cutting surface of the blade with respect to the longitudinal axis of the main body in at least one stop position of the adjustable stop.

In another aspect, an arrow includes a shaft, a nock, and a broadhead. The shaft extends along a longitudinal axis. The nock is at the rear end of the shaft. The broadhead includes a main body, an adjustable stop, and at least one blade. The main body has a longitudinal axis coinciding with the longitudinal axis of the shaft. The adjustable stop is affixed to the main body and has a plurality of stop positions. The adjustable stop is configured to contact the blade in the deployed position of the blade and set an angle of the main cutting surface of the blade with respect to the longitudinal axis of the main body in at least one stop position of the adjustable stop.

In another aspect, a hunting instrument includes an arrow and a bow. The arrow includes a shaft, a nock, and a broadhead. The shaft extends along a longitudinal axis. The nock is at the rear end of the shaft. The broadhead includes a main body, an adjustable stop, and at least one blade. The main body has a longitudinal axis coinciding with the longitudinal axis of the shaft. The adjustable stop is affixed to the main body and has a plurality of stop positions. The adjustable stop is configured to contact the blade in the deployed position of the blade and set an angle of the main cutting surface of the blade with respect to the longitudinal axis of the main body in at least one stop position of the adjustable stop. The bow is configured to engage the nock and the shaft and launch the arrow at a target.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position is a firing position of a bow and arrow, wherein the bow extends generally vertically, and the arrow extends generally horizontally. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 1:
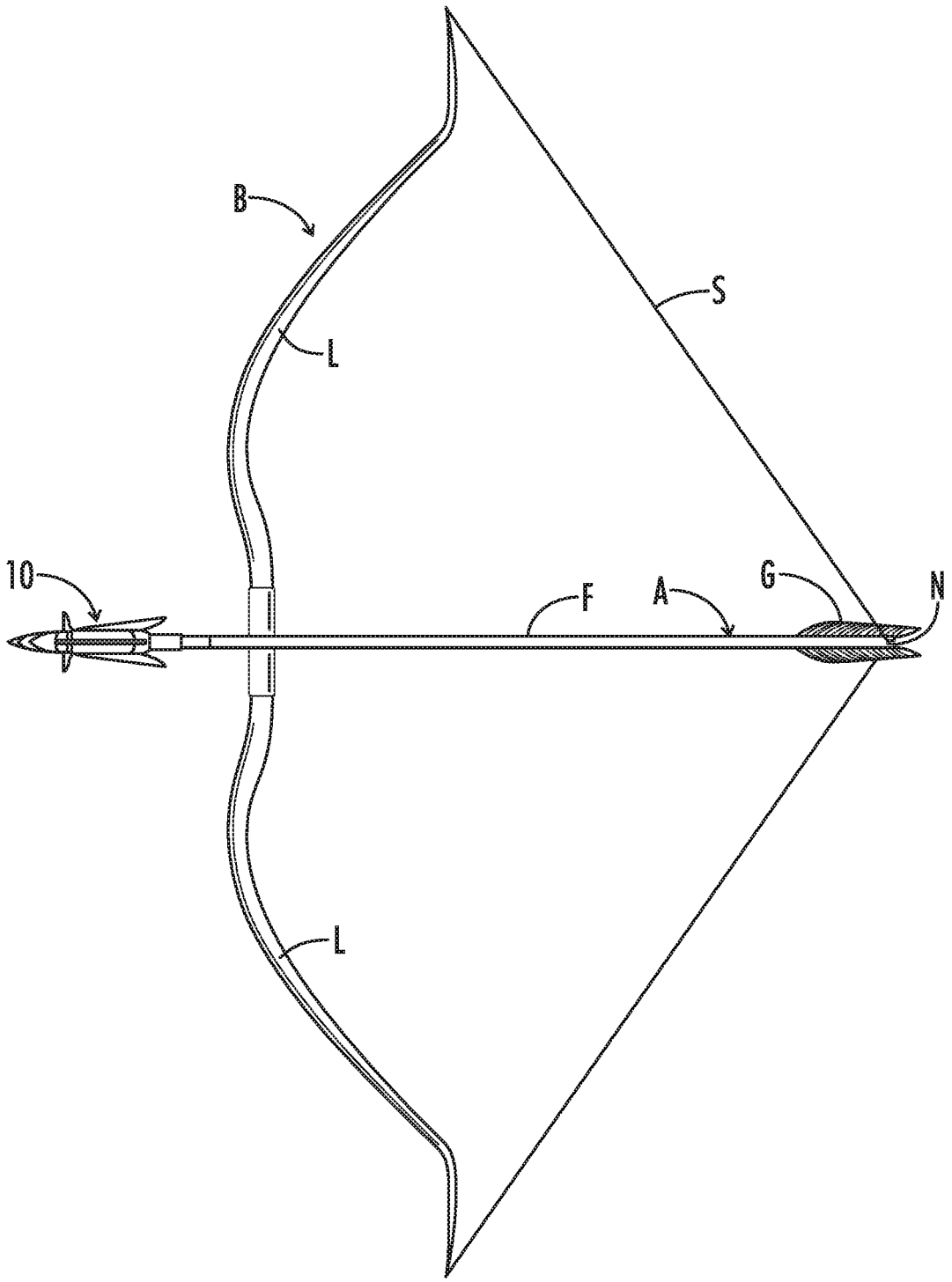
FIG. 1 is a side perspective view of a bow and arrow in an upright position prepared to launch an arrow including a broadhead toward a target upon release.
Figure 2:
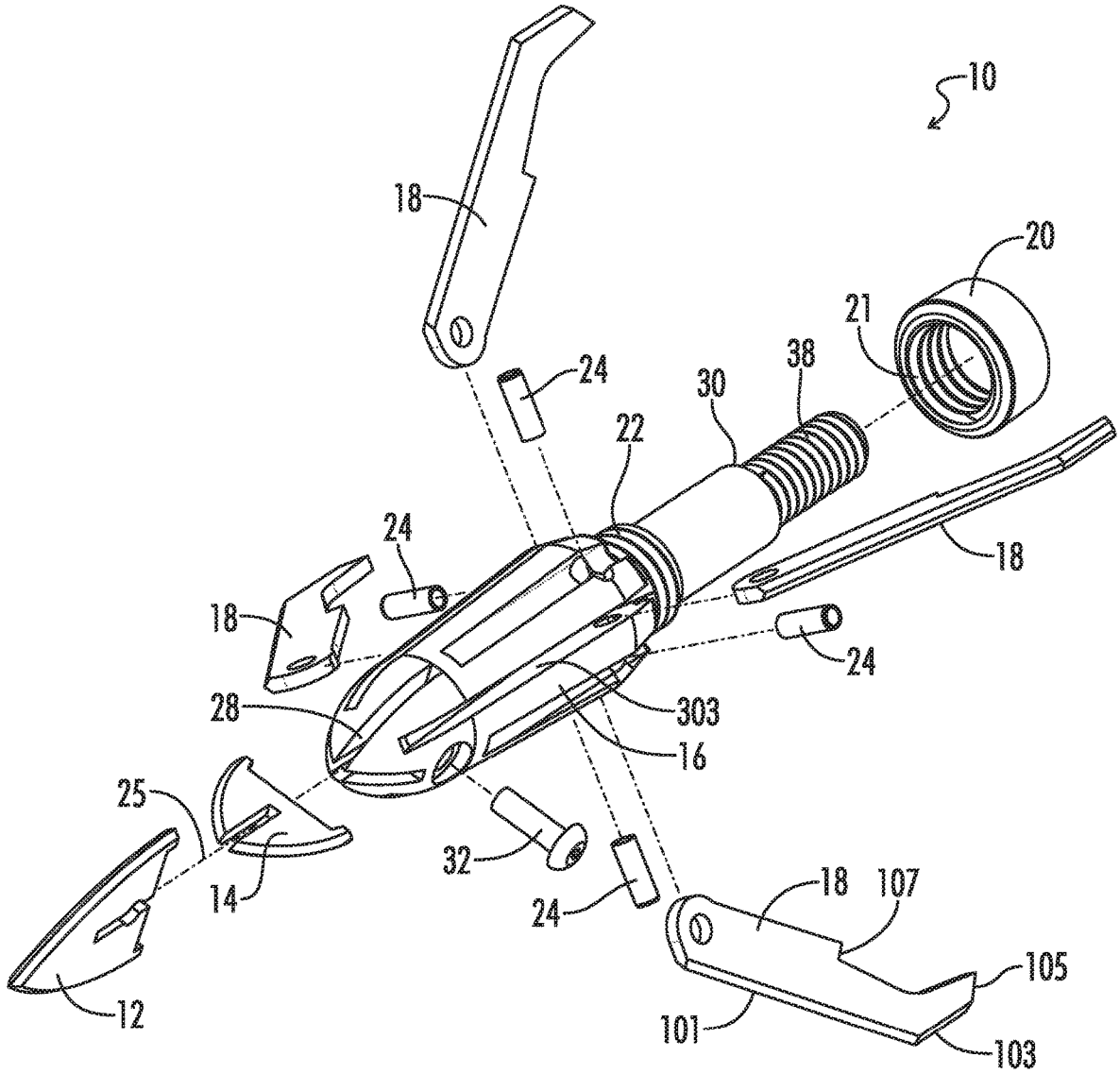
FIG. 2 is an exploded view of a broadhead according to one embodiment of the invention.
Figure 3:
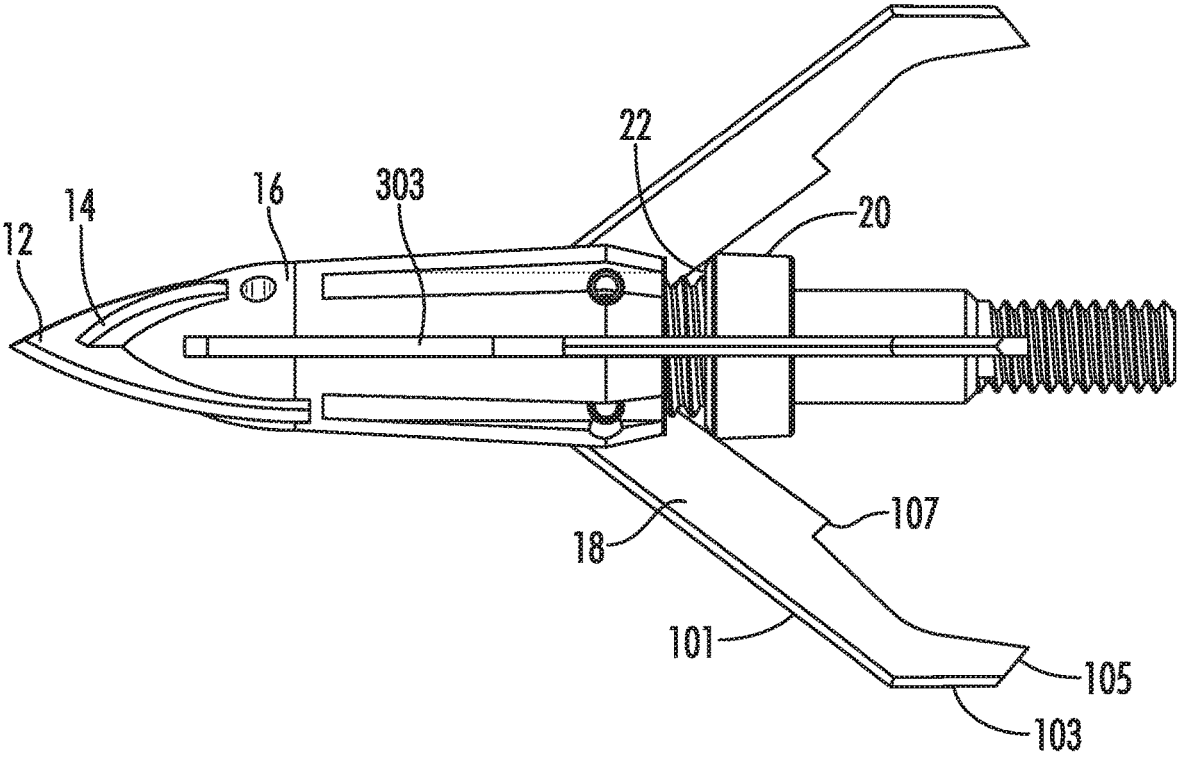
FIG. 3 is a side perspective view of the broadhead of FIG. 2 with the blade in an open or deployed position and the adjustable stop set for a narrow cutting span.
Figure 4:
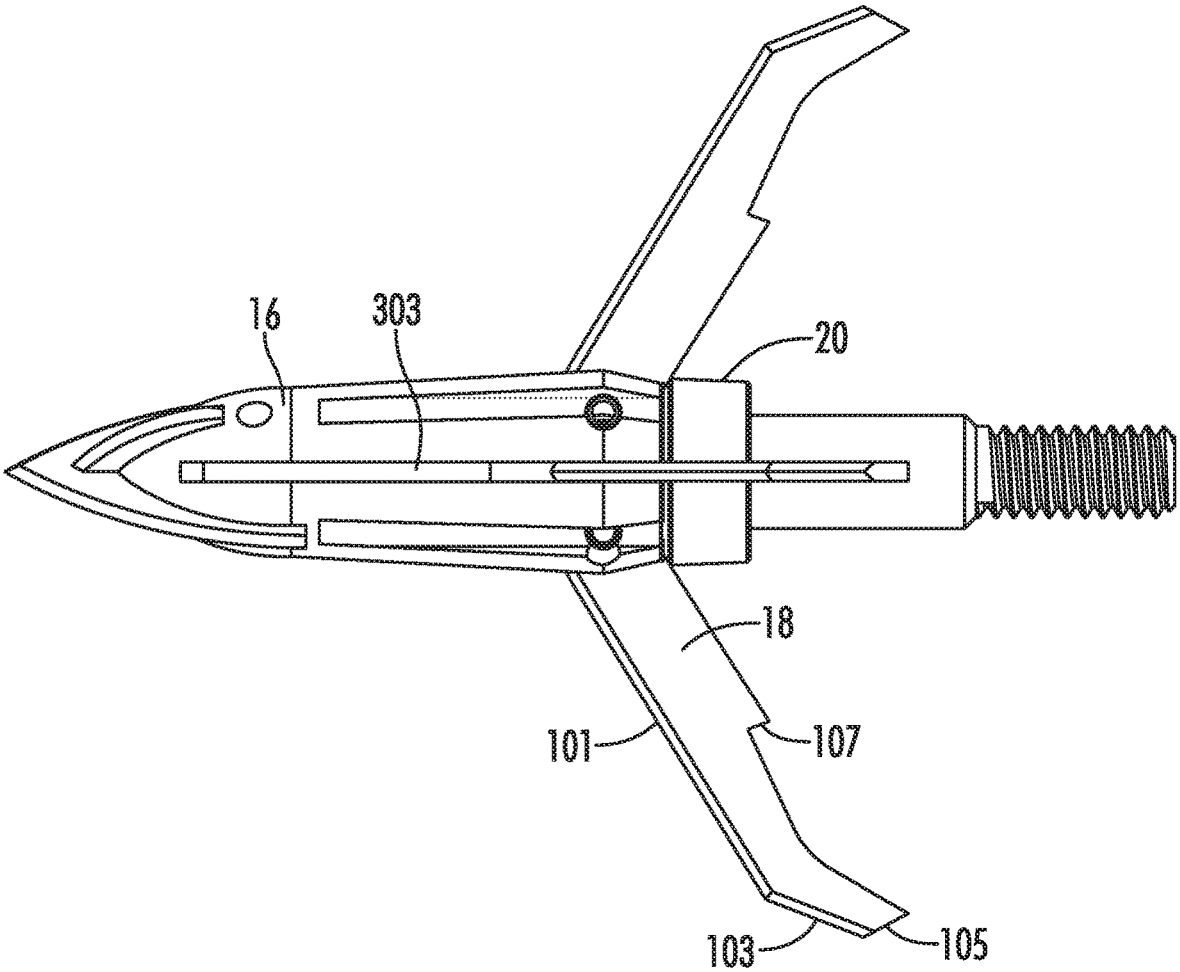
FIG. 4 is a side perspective view of the broadhead of FIG. 2 with the blade in an open or deployed position and the adjustable stop set for a wide cutting span.
Figure 5:
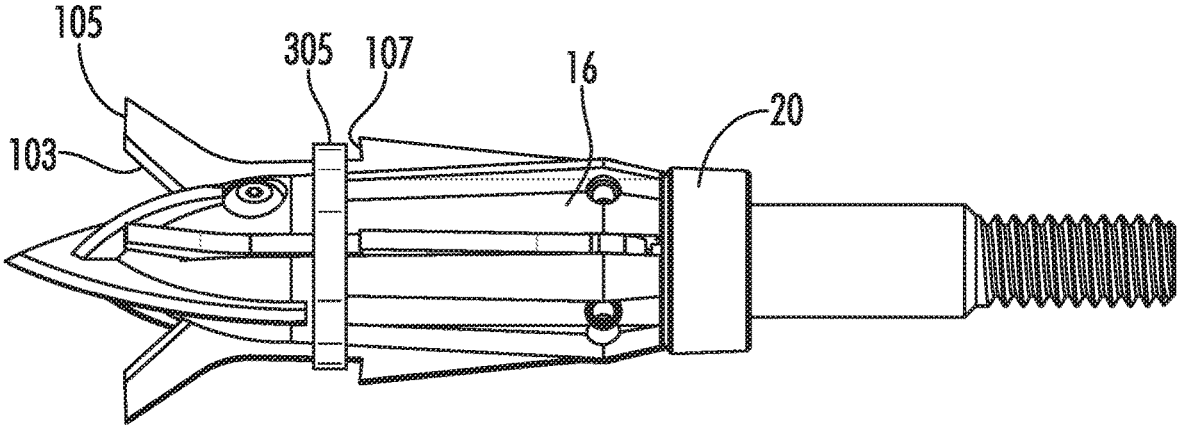
FIG. 5 is a side perspective view of the broadhead of FIG. 2 with the blade in a closed or retracted position and the adjustable stop set for a narrow cutting span.

Referring to FIG. 1, in one embodiment, a hunting instrument includes a broadhead 10 attached to a forward end of an arrow A, which includes a shaft F, fletching G, and a nock N, which receives a string S, and the string being attached to limbs L of bow B. As shown in FIG. 1, arrow A is in a position ready for release with string S and bow B being under tension. Arrow A is thus ready to be launched downrange towards a target, which could include a fixed target, moving target, practice target, or prey (which could include an animal such as deer, elk, etc.).

Referring to FIGS. 2-5, in one embodiment, a broadhead 10 with user-adjustable blade angle and cutting diameter is shown. The broadhead 10 includes a generally cylindrical main body or ferrule 16 defining a longitudinal axis 25. The ferrule 16 includes a forward portion 28 with a forward end, an aft or rearward portion 30 with a rear end opposite the forward end, and a length extending from the forward end to the aft end. In one embodiment, the main body 16 of the broadhead 10 forms a tip at the forward end for penetrating a target. In one embodiment, the forward portion 28 of the ferrule 16 includes a first tip blade 12 extending forward and radially outward from an outer surface of the main body 16 such that the tip blade 12 contacts the target before the ferrule 16. In one embodiment, a second tip blade 14 is set rearward from the first tip blade 12 at the top of the main body 16. The first and second tip blades 12, 14 can be connected to the ferrule 16 by a fastener such as a screw 32.

The broadhead 10 also includes one or more blades 18 which can be pivotally connected to the ferrule 16 by one or more fasteners, such as a pin 24. The aft portion 30 of the ferrule 16 includes a narrow first threaded section 28 sized and shaped to be received in a threaded socket located in an end of an arrow (not shown). The aft portion 30 of the ferrule 16 also includes a larger second threaded section 22 located aft of the location where the one or more blades 18 are pivotally connected to the ferrule 16. The second threaded section 22 can have a diameter that is greater than the diameter of the first threaded portion 28.

The broadhead 10 further includes an annular collar 20 having a forward surface, a rearward surface, an exterior circumferential surface, a threaded aperture 21 extending at least partially between the forward surface and the rearward surface. In one embodiment, the forward surface is chamfered. The threaded aperture 21 is sized and shaped to receive and threadingly engage the second threaded section 22 on the aft portion 30 of the main body 16. When the second threaded section 22 is received in collar 20, the aft end and first threaded section 28 of the ferrule extend rearwardly from threaded aperture 21 along the longitudinal axis 25. When threadingly engaged with the second threaded section 22 of the ferrule 16, the collar 20 acts as a physical block or barrier that can contact the trailing or rearwardfacing edge of the one or more blades 18 to prevent the blade(s) 18 from deploying beyond a preselected angle relative to the longitudinal axis 25 of the main body 16 when the blades 18 are in a deployed position. The threaded second threaded section 22 and collar 20 thus form an adjustable stop having a plurality (e.g., infinite) stop positions. In one embodiment, threading the collar 20 further on the second threaded section 22 so that the collar 20 moves along the longitudinal axis 25 toward the forward end of the ferrule increases the angle of the blade relative to axis 25, while threading the collar 20 rearward on the second threaded section 22 so that the collar 20 moves rearwardly along the longitudinal axis 25 toward the rear end of the ferrule 16 decreases the angle of the blade 18 relative to axis 25.

In one embodiment, the broadhead 10 includes a main body 16, at least one blade 18, and an adjustable stop 20, 22. The adjustable stop is configured to contact the blade 18 in the deployed position of the blade 18 and set an angle of the main cutting surface 101 of the blade 18 with respect to the longitudinal axis 25 of the main body 16 in at least one stop position of the adjustable stop. It is contemplated that in one position (e.g., the narrowest cutting span position), the blade's rear edge may contact the main body 16 instead of the adjustable stop (e.g., collar 20). The collar 20 may be far enough back for this, or the collar 20 may be completely removed in this adjustable stop position. In one embodiment, the stop position of the adjustable stop sets the angle of the main cutting surface 101 of the blade 18 with respect to the longitudinal axis 25 of the main body 16 when the blade 18 is in the deployed position by limiting rearward travel of the blade 18 as the blade pivots rearward to the deployed position from the retracted position when the broadhead 10 impacts the target. In the deployed position, the main cutting surface 101 of the blade 18 has an obtuse angle to the longitudinal axis 25 from the forward tip of the main body 16 and an acute angle to the longitudinal axis 25 from the rear end of the main body 16.

In one embodiment, the main body 16 has a slot 303 for receiving at least a portion of the main cutting surface 101 of the blade 18 when the blade is in the retracted position. In the retracted position, the main cutting surface 101 of the blade 18 is at least partially recessed from the outer surface of the main body within the slot 303. The slot 303 is between the threaded portion 38 configured to engage the arrow shaft F and the forward tip of the main body 16 with respect to the longitudinal axis 25 of the main body 16.

In one embodiment, the blade 18 further comprises a forward cutting surface 103 extending radially outward from the slot 303 when the blade 18 is in the retracted position. The forward cutting surface is thus configured to contact the target and pivot the blade 18 from the retracted position to the deployed position. In one embodiment, the forward cutting surface 103 has an angle between about 30 and 75 degrees with respect to the longitudinal axis 25 of the main body 16 when the blade 18 is in the retracted position. In one embodiment, the blade 18 further includes a blade tip 105 extending radially outwardly from the forward cutting surface 103 and generally perpendicular to the longitudinal axis 25 of the main body 16 when the blade 18 is in the retracted position. The blade tip 105 may be sharpened or dull. In one embodiment, the blade 18 does not have any surfaces rearward of the pivot point configured to contact an outer surface of the target (e.g., the skin of game). That is, all force generated to pivot the blade 18 from the retracted position to the deployed position is provided by the forward cutting surface 103 and/or the blade tip 105. In one embodiment, in the deployed position, the blade tip 105 has an acute angle with respect to the longitudinal axis 25 from the forward tip of the main body 16 and an obtuse angle with respect to the longitudinal axis 25 of the main body 16 from the rear end of the main body 16. In one embodiment, the blade tip 105 is dull and is generally perpendicular to the longitudinal axis 25 when the blade 18 is in the retracted position. In one embodiment, the collar 20 is further configured to lock the blade 18 into the closed position by adjusting up onto the back of the blade 18. In one embodiment, the blade 18 is configured to lock into the retracted position such as by use of a locking pin through the blade 18.

In one embodiment, the blade 18 has a band protrusion 107 configured to extend outwardly from the slot 303 when the blade 18 is in the retracted position such that a band 305 placed about the main body 16 rearward of the forward cutting surface 103 and forward of the band protrusion 107 will remain in place and retain the blade 18 in the retracted position until the broadhead 10 impacts the target. In one embodiment, the broadhead 10 further includes the band 305. The band 305 may be an elastic material such as silicone or rubber, or the band 305 may be an inelastic material such as nylon (e.g., a nylon strap tightened about the broadhead 10 between the notch protrusion 107 and the forward cutting surface 103). The inelastic material may be configured to break upon impact of the broadhead 10 with the target to allow the blade 18 to deploy, or the inelastic material may be configured to remain intact upon impact of the broadhead 10 with the target to retain the blade 18 in the retracted position.

In one embodiment, the arrow A comprises a shaft F, the nock N, and the broadhead 10.

In one embodiment, a hunting instrument includes an arrow A having the broadhead 10, and the bow B.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful BROADHEAD WITH ADJUSTABLE BLADE ANGLE AND CUTTING DIAMETER it is not intended that such references be construed as limitations upon the scope of this invention except as set forth in the following claims.

What is claimed is:

1. A broadhead comprising:

a main body having a longitudinal axis;

an adjustable stop affixed to the main body, said adjustable stop having a plurality of stop positions; and at least one blade having a main cutting surface, said blade further having a retracted position and a deployed position, wherein:

the adjustable stop is configured to contact the blade in the deployed position of the blade and set an angle of the main cutting surface of the blade with respect to the longitudinal axis of the main body in at least one stop position of the adjustable stop;

the main body has a slot corresponding to the blade and the main cutting surface of the blade is at least partially recessed from an outer surface of the main body within the slot when the blade is in the retracted position; and the blade further comprises:

a forward cutting surface extending outward from the slot corresponding to the blade when the blade is in the retracted position such that the forward cutting surface is configured to contact a target and pivot the blade from the retracted position to the deployed position; and a blade tip extending outwardly from the forward cutting surface and generally perpendicular to the longitudinal axis of the main body when the blade is in the retracted position.

2. The broadhead of claim 1, wherein:

the stop position of the adjustable stop sets the angle of the main cutting surface of the blade with respect to the longitudinal axis of the main body when the blade is in the deployed position by limiting rearward travel of the blade as the blade pivots rearward to the deployed position from the retracted position when the broadhead impacts a target.

3. The broadhead of claim 1, wherein:

the main body forms a tip for penetrating a target at a forward end of the main body;

the main body has a threaded portion configured to engage an arrow shaft at a rear end of the main body;

the slot is between the tip and the threaded portion with respect to the longitudinal axis of the main body; and the blade is pivotally attached to the main body such that the blade has a pivot point.

4. The broadhead of claim 3, wherein the adjustable stop comprises:

adjustable stop threads integral with the main body of the main body between the pivot point of the blade and the threaded portion of the main body with respect to the longitudinal axis of the main body; and a collar engaging the adjustable stop threads, said collar configured to move forward or rearward with respect to the longitudinal axis of the main body when the collar is rotated about the longitudinal axis of the main body, depending on a direction of the rotation about the longitudinal axis of the main body.

5. The broadhead of claim 3, wherein the adjustable stop comprises:

adjustable stop threads integral with the main body of the main body between the pivot point of the blade and the threaded portion of the main body; and a collar engaging the adjustable stop threads with threads complementary to the adjustable stop threads, said collar configured to move forward and rearward with respect to the longitudinal axis of the main body when the collar is rotated about the longitudinal axis of the main body, and wherein the adjustable stop threads are integral with the threaded portion of the main body.

6. The broadhead of claim 1, wherein:

the blade has a band protrusion configured to extend outwardly from the slot when the blade is in the retraced position such that a band placed forward of the band protrusion will remain in place and retain the blade in the retracted position until the broadhead impacts a target.

7. The broadhead of claim 1, wherein:

the broadhead further comprises a band configured to retain the blade in the retracted position until the broadhead impacts a target; and the blade further comprises a band protrusion configured to extend outwardly from the slot when the blade is in the retraced position such that when the band is placed forward of the band protrusion and rearward of the forward of the cutting edge about the main body of the broadhead and the blade with the blade in the retracted position, the band will remain in place and retain the blade in the retracted position until the broadhead impacts the target.

8. A broadhead comprising:

a main body having a longitudinal axis;

an adjustable stop affixed to the main body, said adjustable stop having a plurality of stop positions; and at least one blade having a main cutting surface, said blade further having a retracted position and a deployed position, wherein:

the adjustable stop is configured to contact the blade in the deployed position of the blade and set an angle of the main cutting surface of the blade with respect to the longitudinal axis of the main body in at least one stop position of the adjustable stop;

the main body has a slot corresponding to the blade and the main cutting surface of the blade is at least partially recessed from an outer surface of the main body within the slot when the blade is in the retracted position;

the main body forms a tip for penetrating a target at a forward end of the main body;

the blade is pivotally attached to the main body such that the blade has a pivot point;

the blade further comprises:

a forward cutting surface extending outward from the slot corresponding to the blade when the blade is in the retracted position such that the forward cutting surface is configured to contact a target and pivot the blade from the retracted position to the deployed position; and a blade tip extending outwardly from the forward cutting surface and generally perpendicular to the longitudinal axis of the main body when the blade is in the retracted position; and in the deployed position, the main cutting surface of the blade has an obtuse angle to the longitudinal axis from the tip of the main body and an acute angle to the longitudinal axis from a rear end of the main body.

9. The broadhead of claim 8, wherein:

the stop position of the adjustable stop sets the angle of the main cutting surface of the blade with respect to the longitudinal axis of the main body when the blade is in the deployed position by limiting rearward travel of the blade as the blade pivots rearward to the deployed position from the retracted position when the broadhead impacts a target.

10. The broadhead of claim 8, wherein:

the main body has a threaded portion configured to engage an arrow shaft at a rear end of the main body; and the slot is between the tip and the threaded portion with respect to the longitudinal axis of the main body.

11. The broadhead of claim 10, wherein the adjustable stop comprises:

adjustable stop threads integral with the main body of the main body between the pivot point of the blade and the threaded portion of the main body with respect to the longitudinal axis of the main body; and a collar engaging the adjustable stop threads, said collar configured to move forward or rearward with respect to the longitudinal axis of the main body when the collar is rotated about the longitudinal axis of the main body, depending on a direction of the rotation about the longitudinal axis of the main body.

12. The broadhead of claim 10, wherein the adjustable stop comprises:

adjustable stop threads integral with the main body of the main body between the pivot point of the blade and the threaded portion of the main body; and a collar engaging the adjustable stop threads with threads complementary to the adjustable stop threads, said collar configured to move forward and rearward with respect to the longitudinal axis of the main body when the collar is rotated about the longitudinal axis of the main body, and wherein the adjustable stop threads are integral with the threaded portion of the main body.

13. The broadhead of claim 8, wherein:

the blade has a band protrusion configured to extend outwardly from the slot when the blade is in the retraced position such that a band placed forward of the band protrusion will remain in place and retain the blade in the retracted position until the broadhead impacts a target.

14. The broadhead of claim 8, wherein:

the broadhead further comprises a band configured to retain the blade in the retracted position until the broadhead impacts a target, wherein:

the blade further comprises a band protrusion configured to extend outwardly from the slot when the blade is in the retraced position such that when the band is placed forward of the band protrusion and rearward of the forward of the cutting edge about the main body of the broadhead and the blade with the blade in the retracted position, the band will remain in place and retain the blade in the retracted position until the broadhead impacts the target.

15. A broadhead comprising:

a main body having a longitudinal axis;

an adjustable stop affixed to the main body, said adjustable stop having a plurality of stop positions; and at least one blade having a main cutting surface, said blade further having a retracted position and a deployed position, wherein:

the adjustable stop is configured to contact the blade in the deployed position of the blade and set an angle of the main cutting surface of the blade with respect to the longitudinal axis of the main body in at least one stop position of the adjustable stop;

the main body has a slot corresponding to the blade and the main cutting surface of the blade is at least partially recessed from an outer surface of the main body within the slot when the blade is in the retracted position;

the main body forms a tip for penetrating a target at a forward end of the main body;

the blade is pivotally attached to the main body such that the blade has a pivot point;

the blade further comprises:

a forward cutting surface extending outward from the slot corresponding to the blade when the blade is in the retracted position such that the forward cutting surface is configured to contact a target and pivot the blade from the retracted position to the deployed position; and a blade tip extending outwardly from the forward cutting surface and generally perpendicular to the longitudinal axis of the main body when the blade is in the retracted position; and in the deployed position, the blade tip has an acute angle to the longitudinal axis from the tip of the main body and an obtuse angle to the longitudinal axis from a rear end of the main body.

16. The broadhead of claim 15, wherein:

the stop position of the adjustable stop sets the angle of the main cutting surface of the blade with respect to the longitudinal axis of the main body when the blade is in the deployed position by limiting rearward travel of the blade as the blade pivots rearward to the deployed position from the retracted position when the broadhead impacts a target.

17. The broadhead of claim 15, wherein:

the main body has a threaded portion configured to engage an arrow shaft at a rear end of the main body; and the slot is between the tip and the threaded portion with respect to the longitudinal axis of the main body.

18. The broadhead of claim 17, wherein the adjustable stop comprises:

adjustable stop threads integral with the main body of the main body between the pivot point of the blade and the threaded portion of the main body with respect to the longitudinal axis of the main body; and a collar engaging the adjustable stop threads, said collar configured to move forward or rearward with respect to the longitudinal axis of the main body when the collar is rotated about the longitudinal axis of the main body, depending on a direction of the rotation about the longitudinal axis of the main body.

19. The broadhead of claim 17, wherein the adjustable stop comprises:

adjustable stop threads integral with the main body of the main body between the pivot point of the blade and the threaded portion of the main body; and a collar engaging the adjustable stop threads with threads complementary to the adjustable stop threads, said collar configured to move forward and rearward with respect to the longitudinal axis of the main body when the collar is rotated about the longitudinal axis of the main body, and wherein the adjustable stop threads are integral with the threaded portion of the main body.

20. The broadhead of claim 15, wherein:

the blade has a band protrusion configured to extend outwardly from the slot when the blade is in the retraced position such that a band placed forward of the band protrusion will remain in place and retain the blade in the retracted position until the broadhead impacts a target.

* * * * *